United States Patent [19]

Hogue

[11] 4,372,049

[45] Feb. 8, 1983

[54] FRAMING LAYOUT METHOD AND DEVICE

[76] Inventor: Utah Hogue, 11417 Seagoville Rd., Balch Springs, Tex. 75180

[21] Appl. No.: 278,174

[22] Filed: Jun. 29, 1981

[51] Int. Cl.[3] ..... B43L 13/00

[52] U.S. Cl. ..... 33/36; 33/37; 101/328

[58] Field of Search ..... 101/327–331, 101/116, 118, 216; 33/35, 36, 37, 38, 141 R

[56] References Cited

U.S. PATENT DOCUMENTS

| | | | |
|---|---|---|---|
| 587,261 | 7/1897 | Jahn . | |
| 1,423,325 | 7/1922 | Heberling . | |
| 1,723,046 | 8/1929 | Lerner . | |
| 2,012,670 | 8/1935 | Mack | 101/91 |
| 2,130,356 | 9/1938 | Marshall | 91/12 |
| 2,228,990 | 1/1941 | Everson | 33/141 |
| 2,237,228 | 4/1941 | Jobe | 101/328 |
| 2,312,625 | 3/1943 | Cathey | 101/327 |
| 2,451,595 | 10/1948 | Wheeler | 101/328 |
| 2,863,388 | 12/1958 | Schloemer | 101/327 |
| 3,006,273 | 10/1961 | Sommer | 101/114 |
| 3,034,208 | 5/1962 | Kime | 29/407 |
| 3,035,517 | 5/1962 | Bonsch | 101/132.5 |
| 3,046,884 | 7/1962 | Pearson | 101/329 |
| 3,063,370 | 11/1962 | Eberhardt | 101/329 |
| 3,086,460 | 4/1963 | Denning | 33/36 |
| 3,537,394 | 11/1970 | Swapp | 101/328 |
| 3,546,779 | 12/1970 | Klein | 33/36 |
| 3,896,725 | 7/1975 | Grover | 101/330 |
| 3,988,835 | 11/1976 | Thornton | 33/36 |

*Primary Examiner*—Harry N. Haroian

*Attorney, Agent, or Firm*—Thomas L. Cantrell; Joseph H. Schley

[57] ABSTRACT

Disclosed are a method and apparatus for marking beams for the placement of studs, rafters and joists. The invention uses three instruments for measuring, aligning and marking. The first and simplest instrument is a tee-square instrument which requires independent measuring to determine the desired framing position. At the desired position, ink pads are pressed against the beam to mark the location. The ink pads protrude from a blotter head assembly which releasably attaches through a neck to a refillable ink cartridge. Single center distances of regular and uniform spacing are marked with an instrument having blotter head assemblies removably mounted through the periphery of a wheel at even fractions of the circumference. The wheel is rotably mounted on an axle to which a handle is attached and the wheel has gripping teats which insure the accurate translation from circumferential to linear distances. A multi-wheel instrument is disclosed for single pass measuring and marking of beams to which more than one type of framing element will attach. Different centering distances are provided by wheels of different circumferences simultaneously rolling upon the beam. The wheels are carried on an off-set axle to which a handle is attached. Further it is preferred that the wheels be interconnected with minor imposition to relative movement. It is also preferred to provide a center guide to aid in aligning at the beginning of a run.

7 Claims, 5 Drawing Figures

FRAMING LAYOUT METHOD AND DEVICE

BACKGROUND

Frame construction depends upon regular and uniform spacing of studs, rafters and joists at standard intervals. An industry standard has developed of placing studs within the walls on 16 inch centers and of 24 inch centers for non-load bearing studs. Ceiling joists are typically set on 16 inch centers and rafters are set on 24 inch centers. Further, these standards have been adopted in numerous construction codes which control the design of insulation bats and various fixtures that are internal to the walls or ceiling. The acceptance of a standard also aids in the installation of wall coverings and for structurally anchoring fixtures through the wall once the plasterboard or other wall covering is in place and the frame is no longer visible.

The placements of the studs, rafters and joists are measured and marked on horizontal beams to which the ends of the members connect. The increments must be both measured and marked accurately. It is also important that these steps proceed as rapidly as possible.

Finally, the simplicity and durability of any device and method performing these functions is also of paramount importance in order to provide that the process can be reliably performed with a minimum of specialized training and that the equipment will stand up to the rigor of construction site operations.

SUMMARY OF THE INVENTION

Three functions are provided by the present invention, alignment, measuring and marking.

The beam at the top of the stud wall must be marked both for rafter and for joist connection. The two wheel layout instrument allows a one pass alignment, measuring, and marking procedure. The measurements for these dissimilar increments is provided by two interconnected wheels which allow the simultaneous measuring and marking of both centers. The marking means are provided by blotter heads which discharge ink from a reservior through the periphery of the wheel to outline the placement of the rafters and joists. The wheels are carried upon an offset axle which is fixed to a handle by which the device is manipulated. One of the wheels has a rim or flange which keeps the wheels in alignment with the edge of the horizontal beam and each wheel carries gripping teats to ensure correspondance of circumferential to linear distance.

The regular pattern of stud attachments is often altered by the placement of windows and doors and for these positions alignment and marking means are used independently by the measuring wheel and a tee-square embodiment is appropriate.

A single wheel layout instrument is also disclosed for measuring and marking the lower beam and other applications requiring a single center distance. The single wheel device also uses a rim for alignment and gripping teats for preventing slippage between the rolling wheel and the beam to be marked. Blotter heads are employed in the periphery of the wheel for marking purposes. The blotter heads are removably affixed to the wheel and are provided with cartridge reserviors which are easily removed, refilled and replaced when empty.

The use of these three instruments together provides a rapid and reliable method of laying out construction.

A BRIEF DESCRIPTION OF THE DRAWINGS

DETAILED DESCRIPTION

Figure 1:
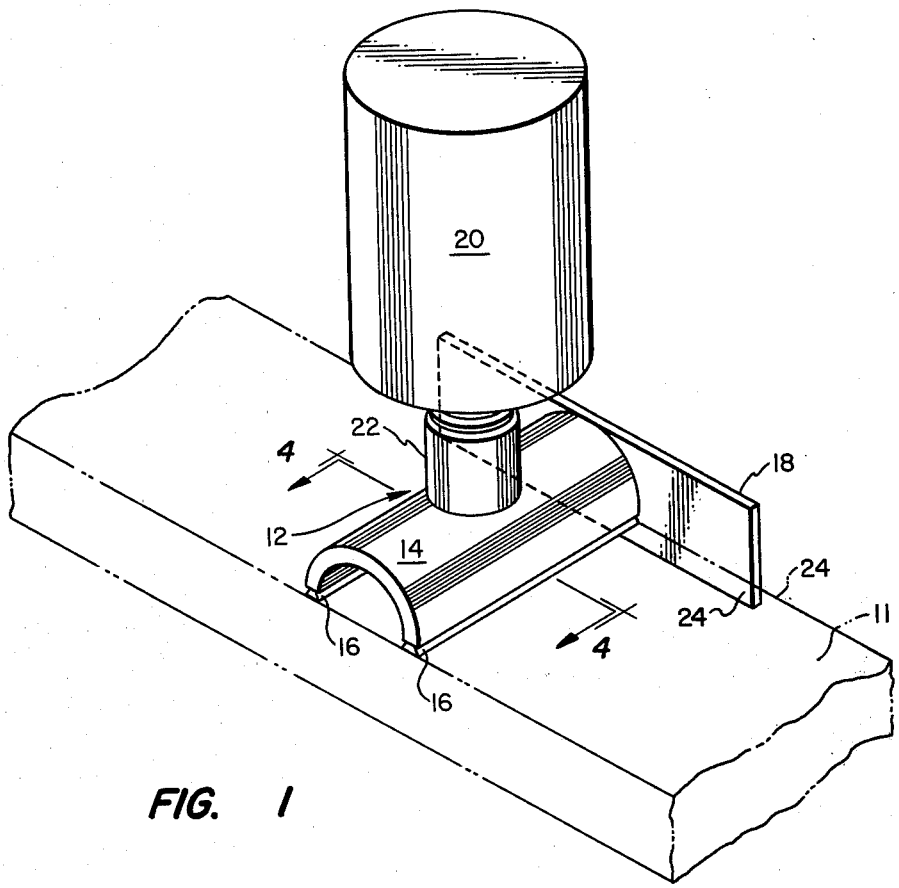
FIG. 1 is a perspective view of a tee-square embodiment of the present invention.

FIG. 1 illustrates the simplest instrument of the present invention and addresses problems of alignment and of marking with a blotter head having a tee-square configuration, here shown marking plate 11. Blotter head assembly 12 carries longitudinal parallel pads 16 on either side of bifurcated supply element 14. Pads 16 are spaced to mark boundaries for the front and back edges of a standard "2×4" stud, rafter or joist. Guide member 18 is connected to bifurcated supply element 14 at a right angle to pads 16 and projects beyond these pads with the engaging face of the guide member, square edge 24. Square edge 24 is placeable against the edge of the frame member to be marked and thereby squares the alignment of pads 16 for marking.

Ink is provided to the pads from a cartridge supply, here bottle 20, which threadingly engages bifurcated supply element 14 at neck 22. Bottle 20 also provides a convenient handle by which the device may be griped for use.

The embodiment of FIG. 1 is particularly useful for marking the layout of corners, doors and windows which are not in the regular order and require measuring independent of the otherwise uniform spacing. After such independent measuring, square edge 24 is placed against the edge of the plate and ink laden pads 16 are pressed against the plate to leave a squared imprint bounding the position of a framing member.

Figure 2:
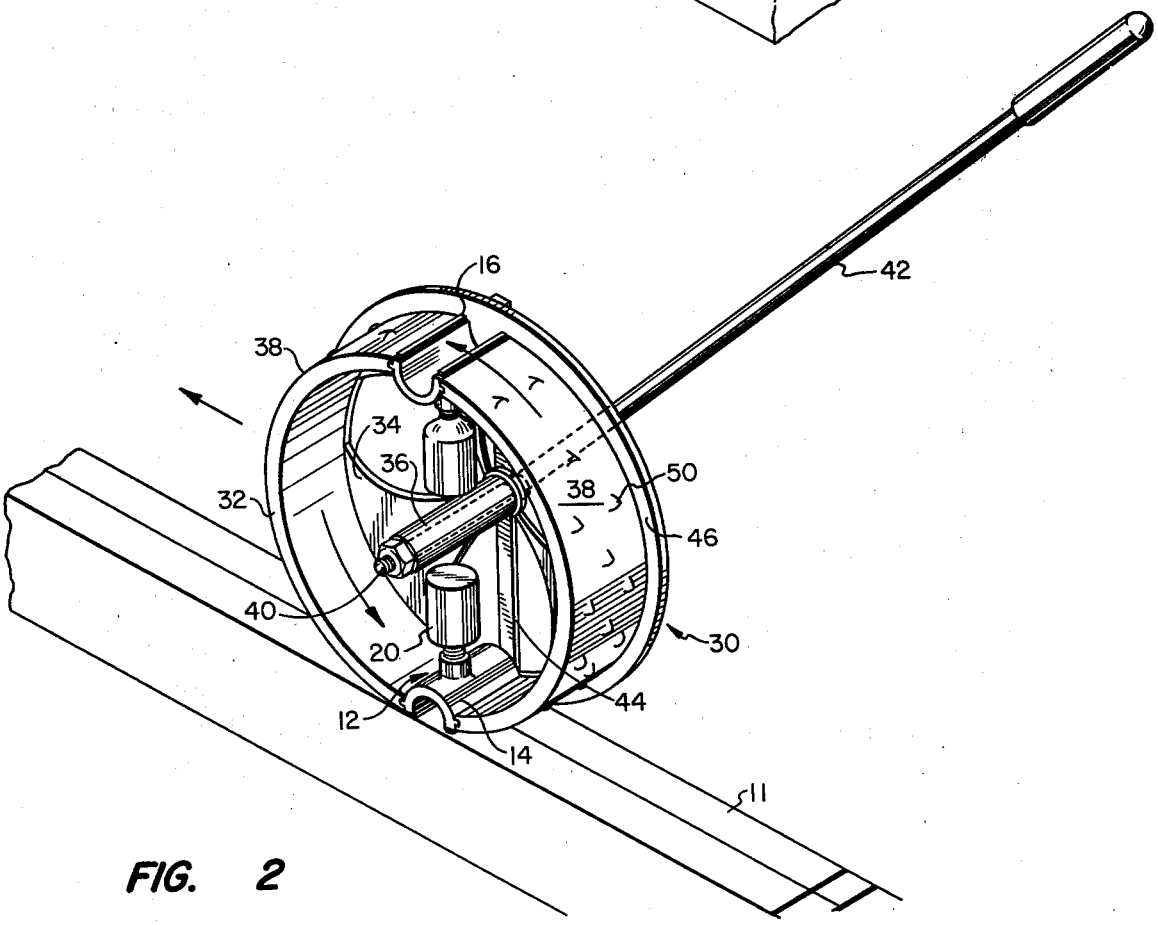
FIG. 2 is a perspective view of a single wheel embodiment of the present invention.

FIG. 2 illustrates an embodiment of the present invention providing a means for accurate and repeated measuring of uniform center positions. Wheel 32 of layout device 30 has a circumference that is divisible into whole numbers of the desired centering distance. The wheel is supported by a substantially open means such as mag-wheel supports 34 which connect hub 36 to periphery 38 of wheel 32. The mag-wheel supports are illustrated connected at the end of the hub although it is desirable to place the mag-wheel supports in the center of the wheel and at the center of the hub when light weight materials such as plsstics are used. The wheel is rotatably attached to axle 40 at the hub and handle 42 is attached to the axle.

Blotter head assemblies 12 are attached to periphery 38 of the wheel with a tongue and groove engagement and present parallel ink pads 16 to contact surface 11 upon which wheel 32 is rolled. The blotter head carries a bifurcated supply means 14 which provides ink from bottle 20 to ink pads 16. Blotter heads 12 divide the circumference of wheel 32 into increments that, when lineraly applied, establish centering lengths.

In addition, it is preferred to provide center guide 44 to aid in aligning the beginning of a run and to realign the centers into phase where the frame structure breaks continuity.

Use of the device begins with alignment of center guide 44 with an established center position such as the first center distance from a corner. At this centered position periphery 38 rests upon plate 11 to be marked and rim 46 is brought firmly against an edge of the plate. The wheel is run the length of the plate by rolling the device the along the plate with rim 46 engaging the side of plate 11. Teats 50 on the periphery of wheel 32 ensure that circumferential distance around the wheel is directly translated to linear distance along the plate with a minimum of relative slippage. The wheel is rolled upon the plate and the ink pads 16 are successively brought into contact with the surface of the plate. Ink is carried from the cartridge, through neck 22 and supply member 14 to ink pads 16 which deposit the ink upon the surface of the plate upon contact. See also FIG. 4. However, supply members 14 in the wheeled embodiments are provided with rapid attachment means such as the tongue and groove arrangement in FIG. 2. This attachment means allows the easy removal of blotter head assembly 12 from the wheel to provide for easy refilling of bottle 20 with the least possible mess. Alignment of rim 46 with the edge of the plate ensures that the stamped outline is square with the plate.

Further, the usefulness of the single wheel embodiment is enhanced by using easily interchangable wheels that allow one handle and axle and one set of blotter head assemblies to be used with successive single wheels to vary single center distances.

Figure 3:
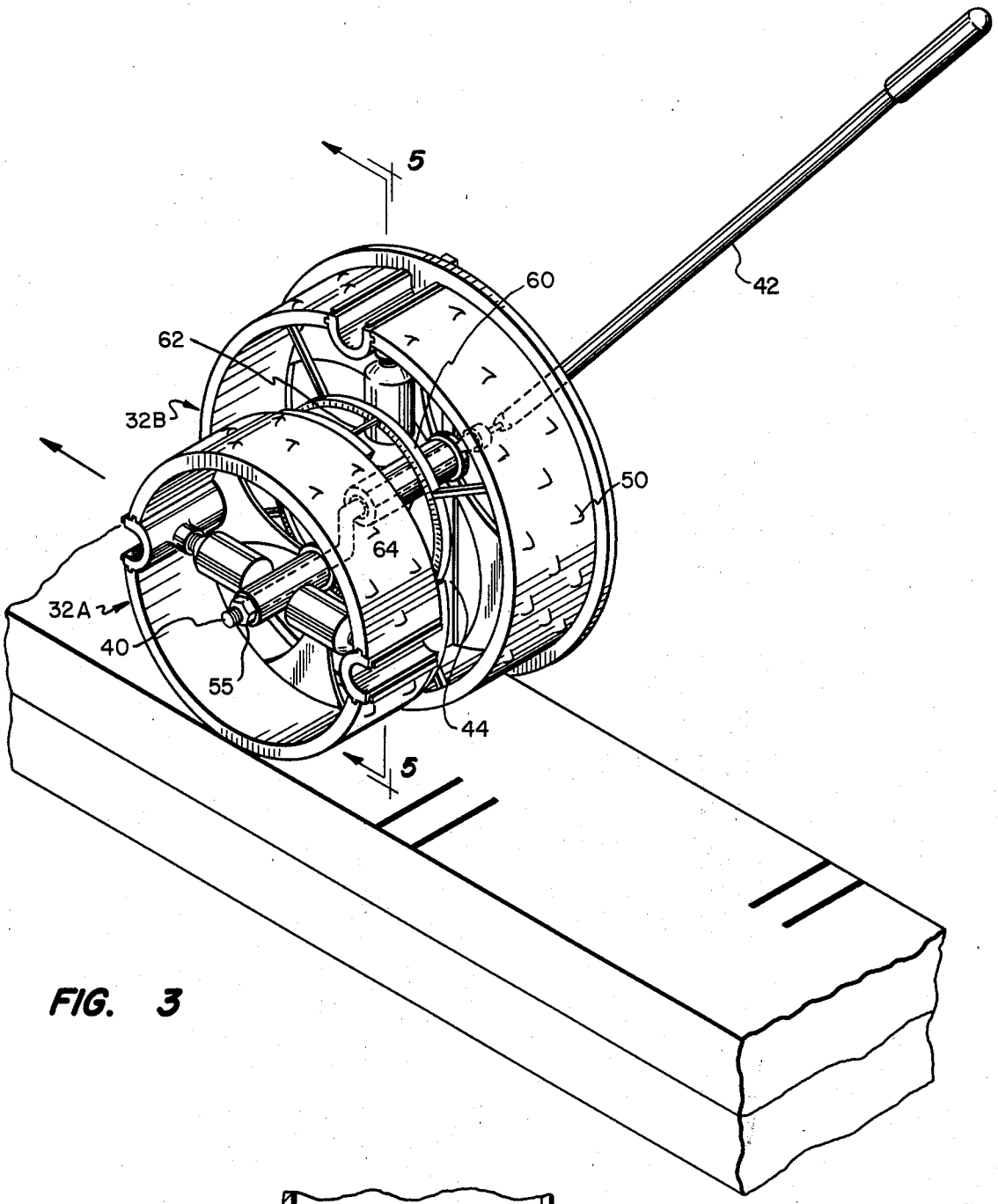
FIG. 3 is a perspective view of a dual wheel embodiment of the present invention.
Figure 4:
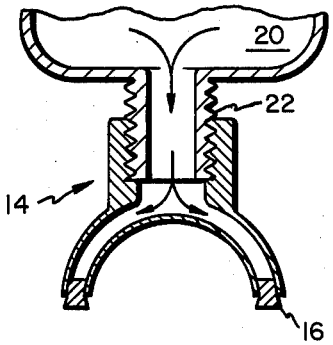
FIG. 4 is a sectional view through a blotter head taken along line 4—4 of FIG. 1.
Figure 5:
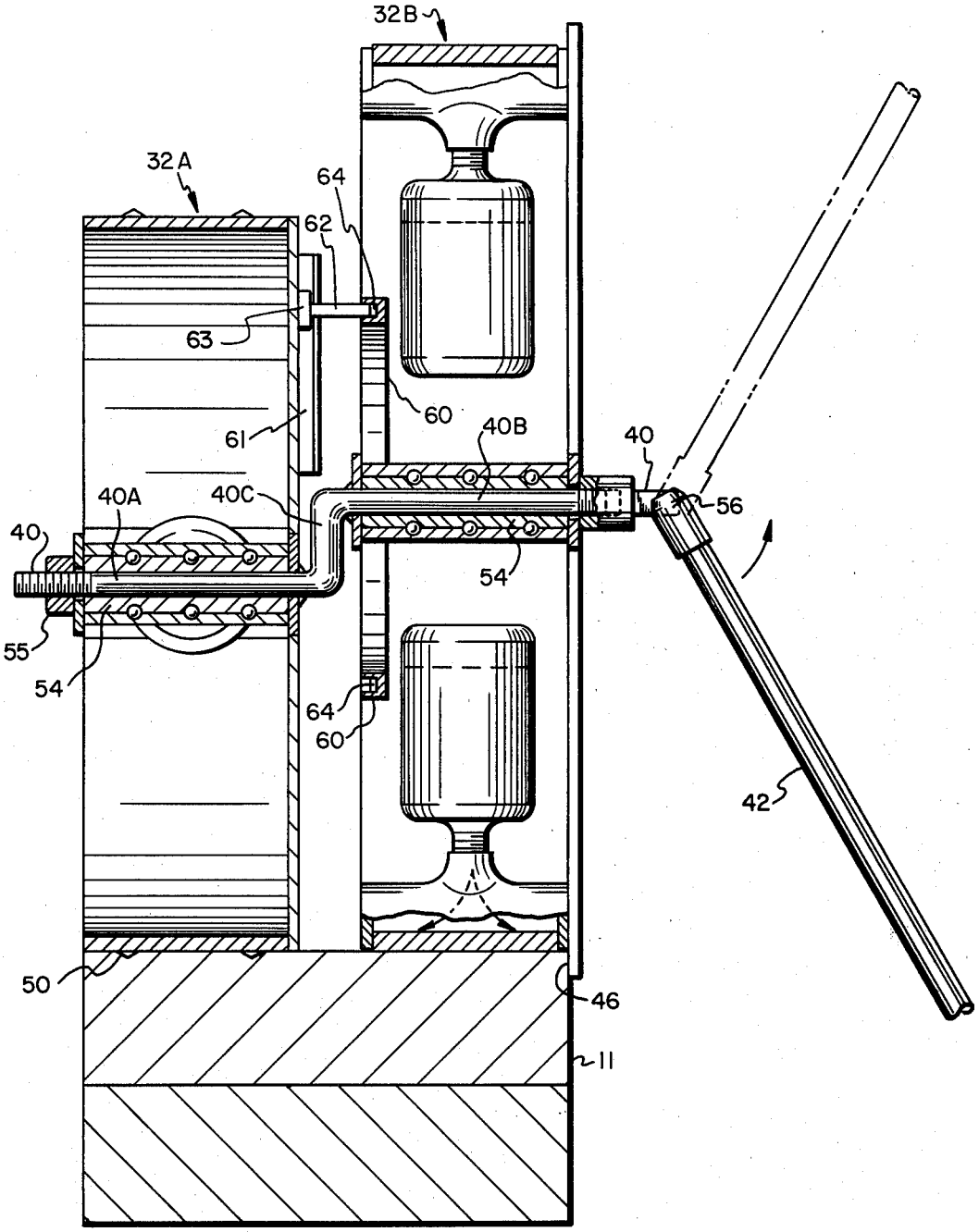
FIG. 5 is a sectional side view of a dual wheel embodiment of the present invention taken along line 5—5 of FIG. 3.

FIGS. 3, 4 and 5 illustrate a dual wheel embodiment of the present invention. Although additional center distances could be simultaneously measured and marked by adding more wheels, the dual wheel configuration serves the most common need by simultaneous measuring and marking 16 inch centers and 24 inch centers for joists and rafters, respectively.

FIGS. 3 and 5 best illustrate the relation of the eccentric wheels in the multi wheel embodiment. There wheel 32A is rotatably attached to axle 40 at offset 40A and wheel 32B is attached to the axle at offset 40B. Bend 40C connects the offset sections of the axle in an eccentric manner disposed to place the periphery of wheels 32A and 32B into alignment at an orientation for simultaneous contact with plate 11. Handle 42 is connected to axle 40 without freedom of rotation so that the orientation of the handle determines the orientation of bend 40C, which in turn establishes the zone of peripherial alignment of the wheels.

The preferred embodiment of the multi-wheel device features some similarities with the single wheeled embodiment discussed above. Both carry gripping teats 50 to provide close correspondence of circumferential distance to linear distances between the center locations. Further, it is preferred that axle to wheel connections be provided with bushings or bearings 54 and that the wheels be secured onto the axles by means such as threaded nuts 55. It is also preferred that extended rim 46 be provided on the handle side wheel in the multi-wheel embodiment. Recall also that it is important in controlling the operative zone that the handle not rotate around axle as do the wheels, however it is preferred that the handle be swivelable in a plane perpendicular to the rotation of the wheels. This provided, swivel 56 allows the operative zone to be in the direction of handle 42 (as illustrated in FIG. 5) for measuring and marking the top of a plate, or allows the operative zone to be opposite the direction of the handle or to measure and mark a plate beneath the operator. (See FIG. 3 and the phantom position in FIG. 5.)

Further, while the preferred embodiment of the multi-wheel device uses the same marking means discussed above for the tee-square and single wheel embodiments, it is here advantageous to use different color ink on the different wheels to prevent confusion.

The use of a multi-wheeled layout device begins with the alignment of the wheels, first to each other, then to an established reference center position on the plate to be measured and marked. Center guide 44 aids in aligning the wheels to the plate. It is referred that the wheels interconnect in a manner that partially resists their movement relative to each other to promote the alignment of the wheels at the beginning of a pass. This interconnection should inhibit the rotation of each wheel with respect to the other and with respect to handle 42. The preferred embodiment accomplishes this by mounting circular track 60 on one wheel of an adjacent pair, here wheel 32B, and mounting resilient tension bar 62 on the adjacent wheel, wheel 32A, to project into said track and engage the corrugated bottom 64. The tension wheel and the track cooperate to prevent relative movement of either wheel with the other wheel and with the handle without deliberately rolling the unit. However, the arrangement presents only a minimum drag during operation and does not materially impede the measuring and marking functions. In the preferred embodiment, base 63 of tension bar 62 is mounted within radial track 61. Mounting base 63 within the radial track allows the radial position of the tension bar on wheel 32A to vary as necessary to run within circular track 60 which is carried on eccentrically rotating wheel 32B. Aternatively, widening corrugated bottom 64 of track 60 can provide a tension bar to circular track engagement for a tension bar fixed to wheel 32A.

A method of using a combination of the preferred embodiments allows simple, accurate, and efficient construction layout. First, placement of corners, doors, and windows are measured by conventional means and the tee square embodiment is used to squarely outline the placement of those studs. The single wheel layout device then measures and marks the placement of the regularly spaced stud framework, based upon the previously established reference points. After the studs are in place and a top plate is afixed atop the wall, the top plate is measured and marked for placement of joists and rafters with the dual wheel device.

I claim:

1. A multi-wheeled framing layout device comprising:

at least two eccentrically mounted, adjacent wheels of differing diameters, each said wheel having a hub, a periphery, and a substantially open means for support connecting said periphery to said hub;

an axle rotably engaging said hubs;

an offset in said axle set between said adjacent wheels;

said offset disposing the wheels in said eccentrically mounted relation and with the periphery of said adjacent wheels into an alignment orientation for simultaneously rolling said wheels in contact with a single planer surface;

means for securing said wheels upon said axle;

a handle attached to an end of said axle in a nonrotable connection; and means for marking said planer surface at the periphery of each of said wheels.

2. A multi-wheeled framing layout device in accordance with claim 1, further comprising:

means for interconnecting said wheels in a manner partially resistant to relative rotation.

3. A multi-wheeled framing layout device in accordance with claim 2 wherein said means for interconnecting said wheels comprises:

a resilient tension bar eccentrically and laterally projecting from the first of two adjacent wheels toward the second wheel of said adjacent pair; and a circular track having a radially corrugated floor on the second of adjacent wheels, said track receiving said tension bar and holding the end of said tension bar against said floor.

4. A multi-wheeled framing layout device in accordance with claim 1 wherein said means for marking comprises:

at least one blotter head assembly comprising:

at least one ink pad projecting to the outside of the periphery of said wheel;

an ink transmitting supply element connected to said ink pad;

a neck connected to said supply element; and oposing tongues protruding laterally from said blotter head assembly;

an ink bottle releasably connected to the neck of said blotter head assembly; and tongue receiving grooves set within the periphery of the wheel;

whereby the blotter head assembly is releasably securable to the periphery of the wheel to allow removal of the blotter head assembly from the wheel during refilling, allowing a full ink bottle to be easily and neatly connected to the neck of the blotter head assembly and thereby presenting a substantially sealed ink filled containment to be reattached to the wheel.

5. A multi-wheeled framing layout device in accordance with claim 2 wherein said means for interconnecting said wheels comprises:

a resilient tension bar eccentrically and laterally projecting from the first of two adjacent wheels toward the second wheel of said adjacent pair;

a circular track having a radially corrugated floor on the second of adjacent wheels, said track receiving said tension bar and holding the end of said tension bar against said floor; and means for mounting said resilient tension bar to said first wheel in a manner which provides the resilient tension bar with freedom to move radially relative to said first wheel.

6. A multi-wheeled framing layout device in accordance with claim 5 wherein said means for mounting said resilient tension bar to said first wheel comprises:

a radial track attached to said first wheel; and a mounting base connected to one end of said resilient tension bar, said mounting base engaging said radial track in a manner that permits the tension bar to move radially relative to the first wheel.

7. A method of measuring and marking the laying out of frame elements in construction, said method comprising the following steps:

measuring of the positions of irregularly spaced framing elements;

aligning ink pads of a tee-square blotter instrument by placing a guide member which is orthogonally attached to a blotter head of the tee-square blotter instrument against the edge of a first beam to be marked;

pressing the ink pads protruding from said blotter head assembly against said first beam;

allowing ink to flow from a releasable cartridge through a neck, through said blotter head assembly, and through said ink pads, thereby marking said first beam for placement of framing elements;

orienting a wheel of a single wheel instrument to a position that brings a blotter head assembly of the single wheel instrument into position for marking;

aligning the single wheel instrument in position upon a second beam which is to be marked at regularly spaced intervals, placing said blotter head assembly of said single wheel instrument over a known center position and bringing a rim about the circumference of said wheel against an edge of said second beam;

rolling said single wheel instrument along the length of said second beam, without slipage during the rolling and maintaining alignment of the wheel to the beam by holding the rim against the edge of said second beam;

marking said second beam at regularly spaced intervals during said rolling step by bringing ink pads presented at the periphery of said wheel into contact with said second beam as the wheel is turned and by allowing ink to flow from replacable cartridges through the blotter head assemblies and through said ink pads;

orienting wheels of a multi-wheeled instrument;

aligning said multi-wheel instrument with a third beam which is to be marked at multiple centering distances by placing said multi-wheeled instrument into position upon said beam with each of said wheels in contact with said third beam, said wheels of differing diameters presenting a single planar contact region to receive tangential contact as provided by offsets in a common axle through said wheels;

rolling said wheels of said multi-wheeled instrument simultaneously by manipulating said instrument through a handle which is non-rotably connected to an axle, maintaining alignment of said multi-wheeled instrument with said third beam by holding a rim of the most exterior of said wheels against the side of said third beam;

simultaneously marking said third beam with multiple centering distances by presenting ink pads through the periphery of each of said wheels and allowing ink to flow from a replaceable cartridge through a blotter head assembly to each of said ink pads which in turn transfer ink to said third beam as they are brought into contact.

* * * * *